United States Patent [19]

Armbruster

[11] Patent Number: 4,483,664

[45] Date of Patent: Nov. 20, 1984

[54] PORTABLE POWER DEVICE, LIGHT AND FAN

[76] Inventor: Joseph M. Armbruster, 2700 NE. 47th St., Lighthouse Point, Fla. 33064

[21] Appl. No.: 352,897

[22] Filed: Feb. 26, 1982

Related U.S. Application Data

[63] Continuation-in-part of Ser. No. 214,867, Dec. 9, 1980, Pat. No. 4,424,006.

[51] Int. Cl.[3] ..... F04B 21/00

[52] U.S. Cl. ..... 417/234; 417/313; 417/411

[58] Field of Search ..... 415/127, 219 B, 219 R, 415/206; 417/234, 411, 313, 423, 350, 360; 416/5; 98/40 DL

[56] References Cited

U.S. PATENT DOCUMENTS

| | | | |
|---|---|---|---|
| 2,065,270 | 12/1936 | De Misa | 417/423 R |
| 2,116,539 | 5/1938 | Payne et al. | 415/127 |
| 2,133,188 | 10/1938 | Conforti | 417/313 |
| 2,278,082 | 3/1942 | Lofgren | 417/350 |
| 2,582,572 | 1/1952 | Tulk | 416/5 |
| 3,120,340 | 2/1964 | Strumpell | 417/350 |
| 3,306,527 | 2/1967 | Cook | 415/127 |
| 3,407,993 | 10/1968 | Bostrom | 415/127 |
| 3,909,589 | 9/1975 | Stone et al. | 98/40 DL |
| 3,916,870 | 11/1975 | Beavers | 126/116 R |

*Primary Examiner*—William L. Freeh
*Assistant Examiner*—Jeffrey A. Simenauer
*Attorney, Agent, or Firm*—Harvey B. Jacobson

[57] ABSTRACT

A portable power device, light and fan including a chassis provided with a light, electric receptacle and switch structure, together with a motor fan unit forming a blower received in a housing supported from the chassis for pivotal movement about a tansverse axis with the blower housing including an outlet oriented above the portion of the chassis having the light, electrical receptacle and switch structure with the outlet in the blower housing being rotatable in a vertical plane about the pivot axis connecting the blower housing to the chassis. A carrying handle is attached to or otherwise provided on the assembly to facilitate its portability. The connection between the blower housing and chassis is uniquely formed by a venturi forming flange on each side wall of the chassis extending into and being closely received in an air inlet in each end wall of the blower housing, thereby forming air inlets for the blower housing and also pivotally supporting the blower housing from the chassis.

4 Claims, 4 Drawing Figures

FIG. 3
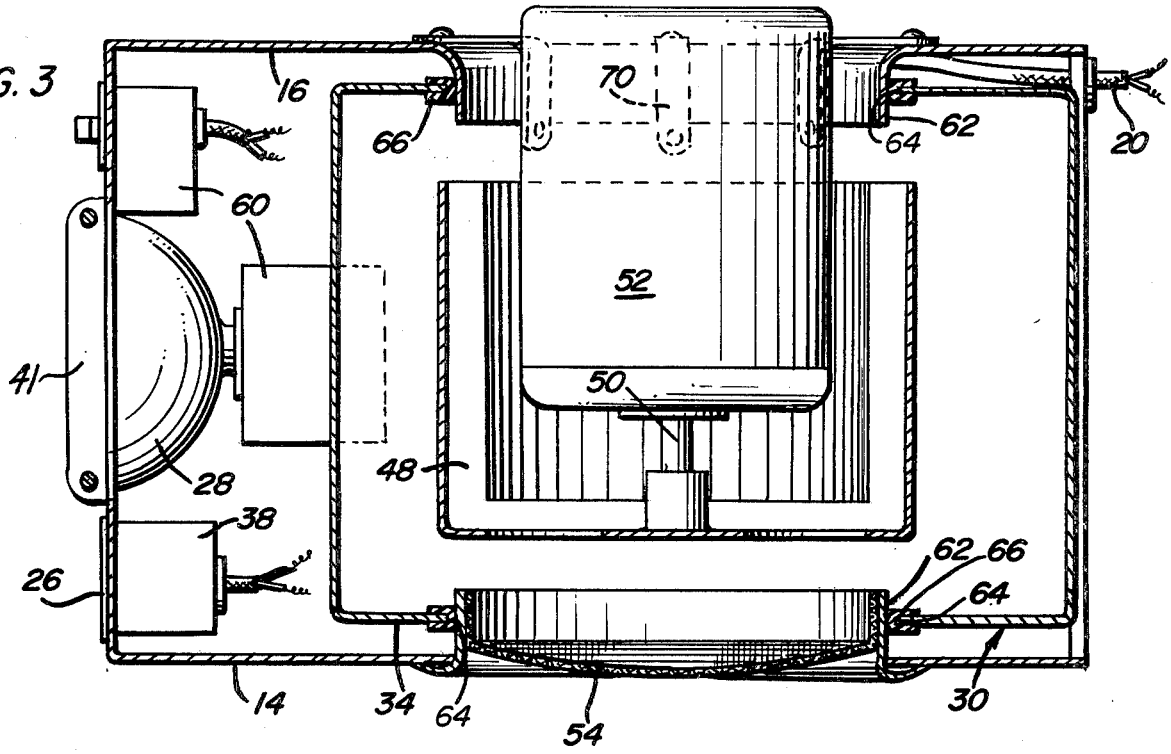
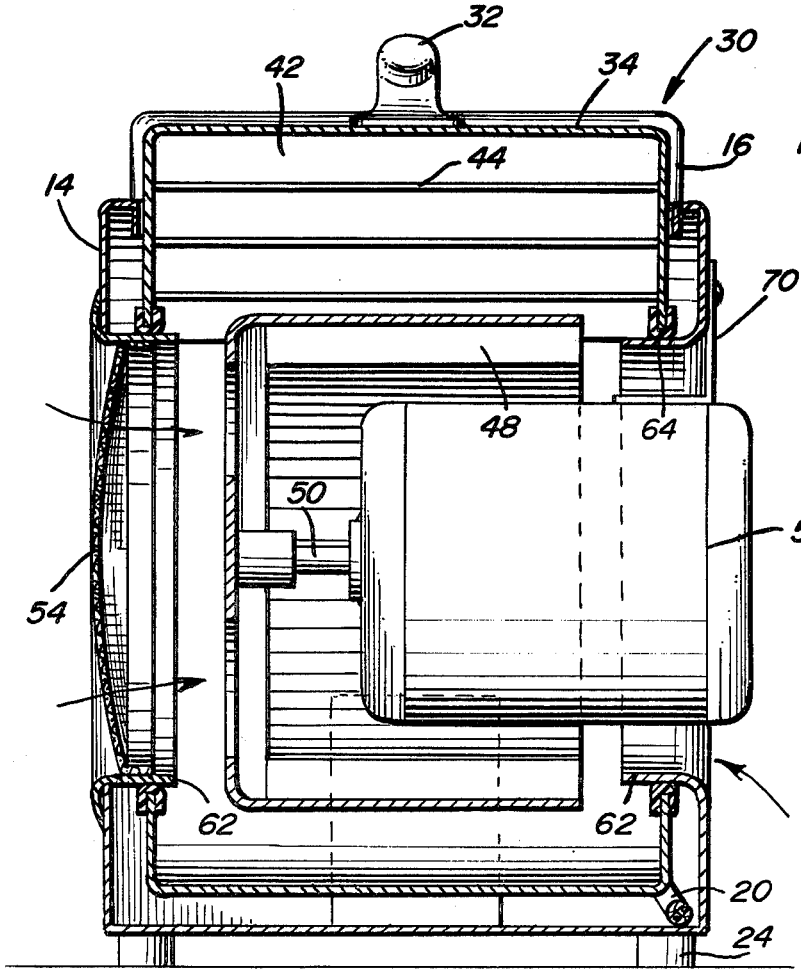
FIG. 4

PORTABLE POWER DEVICE, LIGHT AND FAN

CROSS-REFERENCE TO RELATED APPLICATION

This application is a continuation-in-part of co-pending application Ser. No. 214,867, filed Dec. 9, 1980, for "Combined Power Device, Light and Fan", now U.S. Pat. No. 4,424,006, issued Jan. 3, 1984.

BACKGROUND OF THE INVENTION

1. Field of the Invention

This invention relates to a portable device, and in particular to a device containing a combination of independently operated electrical services including electrical outlets for acting as an electrical extension, a light source and a fan to provide air circulation.

2. Disclosure Statement

U.S. Pat. No. 2,582,572, issued Jan. 15, 1952, to Tulk, and U.S. Pat. No. 2,909,316, issued Oct. 20, 1959, to Prohacka et al, disclose portable electric fans each of which contains an electric light attachment. The portable combination fan and light devices disclosed by these patents comprise conventional rotating prop fans which cannot be adjusted relative to the frame of the device to control the direction of air flow. These combination devices also lack electrical power outlets and thereby cannot act as a source of power for electrically driven tools in remote locations.

U.S. Pat. No. 2,912,195, issued Nov. 10, 1959, to Austin, discloses a support structure for a blower housing comprising means to adjust and change the direction of the output of the blower. The support structure disclosed in this patent is not for a combination device, nor does it appear that the blower housing can be adjusted in all positions ranging from horizontal to vertical. U.S. Pat. No. 2,133,985, issued Oct. 25, 1938, to Green, relates to electric fans and particularly to those in which the motor and fan oscillate back and forth laterally. This patent utilizes a flexible cord which electrically connects the swaying fan with the electric motor.

SUMMARY OF THE INVENTION

In accordance with the present invention, a portable device is provided as a convenient tool when working in areas that lack air circulation and easy access to light and electrical power. The portable device of the present invention includes an electrical power source in the form of an outlet to enable the device to act as an electrical extension cord, a lamp to provide illumination while traversing or working in areas where lighting may be required, and a blower which can be moved relative to the chassis or housing of the device for directing air in any position between horizontal and vertical. In small enclosed areas, air directed vertically toward the ceiling provides a large envelope of circulated air while the horizontal position can be used to direct air directly on the work area or operator. The electrical outlet is provided in a pair of outlets which enable the user of the device to connect electric tools, such as power saws, drills, etc., to a source of electricity. The portable device includes an extension cord which is permanently affixed to the chassis of the device and wired to a switch means and lamp and further provides electricity to operate the blower. The three electrical services provided on the portable device can be used independently of each other.

Accordingly, it is an object of the present invention to provide the home handyman or tradesman with a portable device capable of providing a plurality of electrical services, such as a source of power, light and air circulation.

It is a further object of the invention to provide a portable device positioned in a single chassis and housing, which is portable and which provides a source of power, a source of illumination and a blower for providing air circulation.

A further object of the invention is to provide a portable electrical device containing a source of electrical power and a blower which is movable relative to the chassis of the device to direct air in any position between horizontal and vertical, the device also containing a source of illumination and an electrical receptacle.

A still further object of the invention is to provide a portable electrical device which contains a source of electrical power, a source of illumination and a blower which can provide a flow of air directed in any position between horizontal and vertical and in which any one of the three electrical services can be used independently of the others.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a transverse sectional view of the electrical device taken generally along the line 3—3 of FIG. 2.

FIG. 4 is a transverse sectional view of the device of the present invention taken generally along the line 4—4 of FIG. 2.

DETAILED DESCRIPTION OF THE INVENTION

Figure 1:
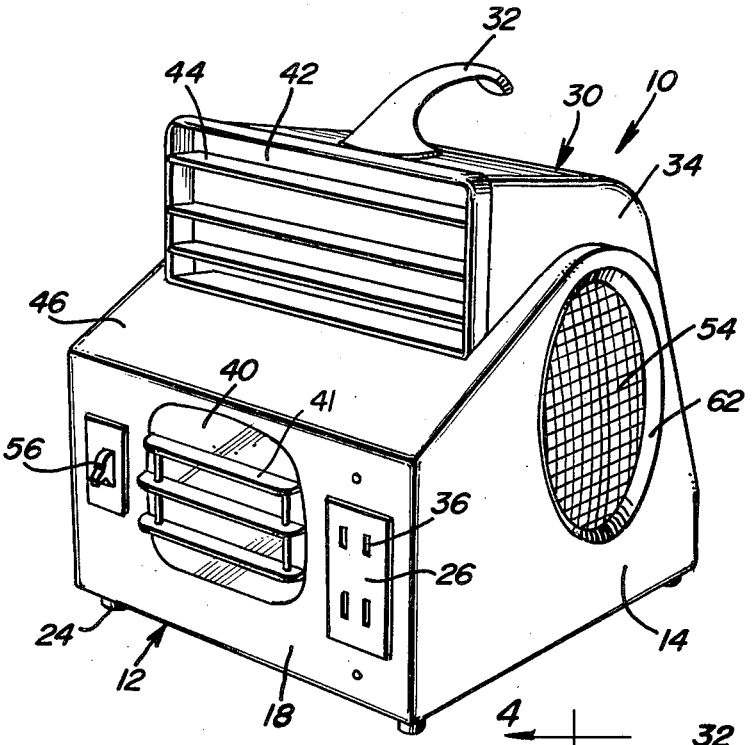
FIG. 1 is a perspective view of the portable device of the present invention.

Referring to the drawings, the portable electrical device of the present invention is generally indicated by reference numeral 10. Device 10 comprises a chassis 12 including a pair of side walls 14 and 16 and a front panel 18. Portable device 10 is connected to a source of electrical power through built-in extension cord 20 containing an electrical connector plug (not shown) at the end thereof. Placed on the bottom of chassis 12 are four rubber pads 24 for supporting device 10 on a flat surface.

Portable electrical device 10 is designed to provide a plurality of electrical services which can operate independently from each other. The electrical services provided comprise a duplex weather guard outlet 26, lamp 28 and blower 30. A handle 32 fastened to or formed on blower housing 34 enables device 10 to be carried easily by hand producing a convenient portable device and enables rotational movement of the blower housing. Duplex electrical outlet 26 is formed by a pair of electrical sockets 36 which may include a pair of weather guards (not shown) for preventing the entry of dust, moisture, etc. Such guards are pivotally mounted to outlet box 38 for conveniently providing access to outlets 36 as shown more fully in Ser. No. 214,867, now U.S. Pat. No. 4,424,006, issued Jan. 3, 1984. Lamp 28, preferably 30 to 40 watts, is provided with a fresnel lens 40 protruding through and affixed to the outside surface of front panel 18 and protective guard bars 41 are provided for the lens and lamp.

Chassis 12 is shaped to accommodate blower housing 34 which is movably mounted between side walls 14 and 16. The cutout portion 17 of chassis 12 accommodates blower housing 34 for all positions of a blower outlet 42, such as the horizontal position shown in FIGS. 1 and 2 to the vertical position in which outlet 42 is positioned vertically upward with a portion of the arcuate front wall extending above the edge of the top wall 46 of the chassis and the end walls of body portion of blower housing 34 is accommodated between side walls 14 and 16. Outlet 42 having placed thereon a grille 44 is positioned slightly above top wall 46 of chassis 12 when outlet 42 is in the full horizontal position. Blower 30 includes a conventional two-speed squirrel cage blower comprising fan 48 rotated by shaft 50 of motor 52.

Switches 56 (only one shown) operate blower 30 and lamp 28, respectively. The switches are part of a conventional electrical circuit including electrical box 60 which receives power through extension cord 20. Power for operating blower 30 is achieved through an electrical connection (not shown) to motor 52. Chassis 12 is electrically grounded for safety. The three electrical services, outlet 26, lamp 28 and blower 30 can be independently operated from each other and thus used singly or in combination depending upon the needs or preferences of the operator.

Figure 2:
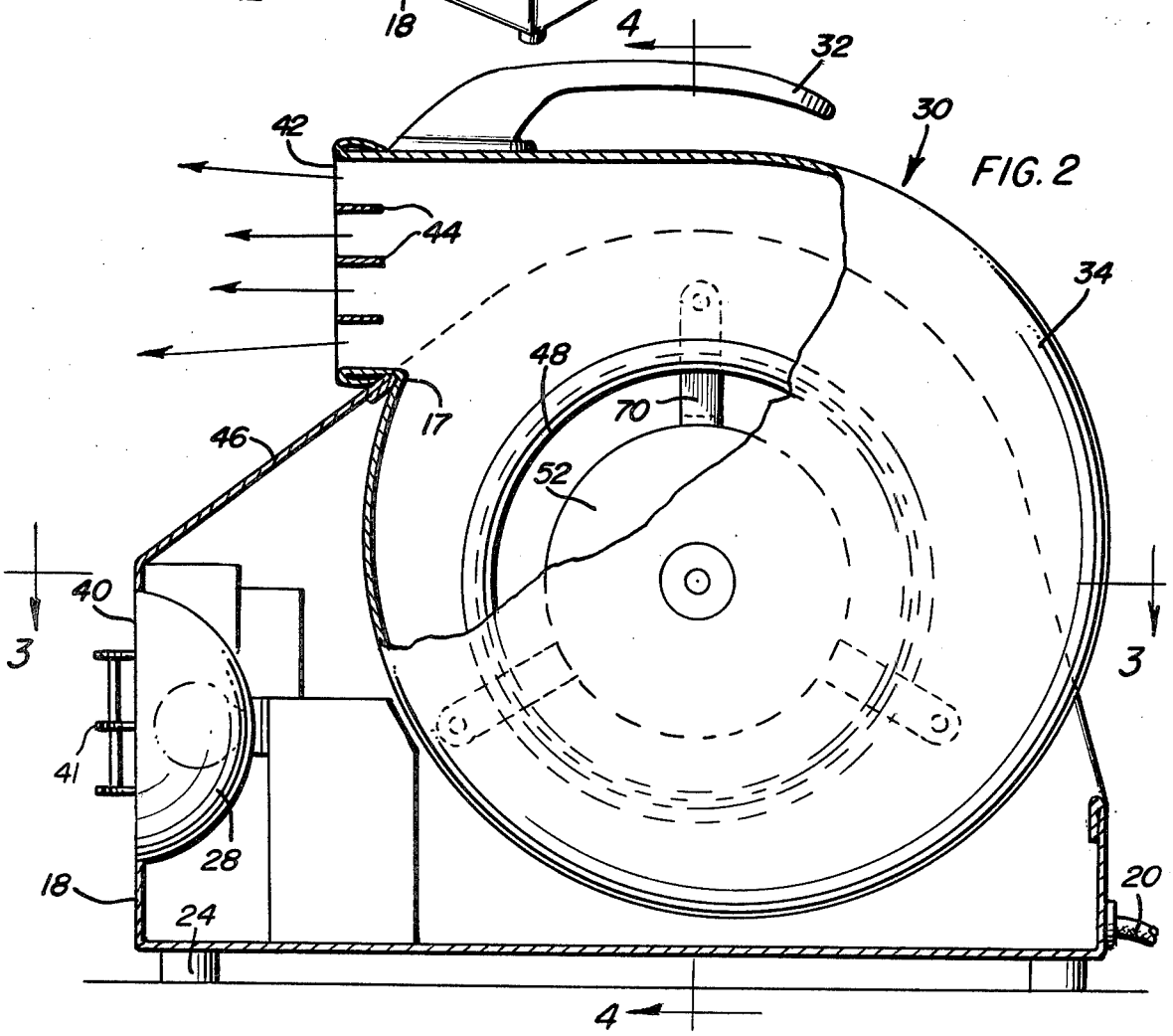
FIG. 2 is a longitudinal sectional view of the device.

An important feature of the present invention involves the movement of outlet 42 of blower 30 from the horizontal position to a vertical position and all directions therebetween. Illustrated in FIGS. 3 and 4 is the mechanism by which the movement of blower 30 to change the direction of air flow is provided. A generally cylindrical flange 62 conforming substantially to the circular shape of air inlets 64 in blower housing 34 is formed at a correspondingly exact position in respective side walls 14 and 16 in chassis 12 the flanges 62 defining openings. Placed on the edge of each opening 64 is a plastic channel 66 which prevents metal-to-metal contact between the flanges 62 and the edge of air inlets 64 while permitting the housing 34 to rotate or pivot and remain in place due to the frictional engagement of the components. When the components are made of plastic, the channels 66 are not necessary. The inwardly curved flanges 62 also form venturi openings for inlet of air to the fan. A protective screen 54 is provided for the openings in wall 14 while the end of motor 52 is positioned in the openings in wall 16 with brackets 70 removably supporting the motor in concentrically spaced relation to the opening. The fan 48 may have a diameter less than the opening in wall 16 in blower housing 34 for disassembly when desired. Also, by making both flanges 62 removable, the blower housing can be removed from chassis 12 after the motor and fan assembly have been removed. As can be seen, the flow of air from outlet 42 can be adjusted to flow in any direction within the 90° angle from horizontal, as shown in FIG. 1, to an upwardly vertical direction without the necessity of manually loosening any fasteners thereby simplifying the use of the device. There are no bolts or nuts to be manipulated when adjusting the position of outlet 42 and the entire device may be easily assembled and disassembled and is capable of prolonged, trouble-free and safe operation.

The materials of construction of the device 10 are preferably lightweight materials, such as aluminum or plastic, or a combination of these materials of construction to form the component parts of the device. Many uses of the device are contemplated and all such conventional uses can be readily determined from the description of device 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A combined portable light, electrical outlet and fan assembly comprising a supporting chassis including a generally vertical front panel and side walls, means supporting the chassis on a support surface, electrical outlet socket means mounted on said front panel, a light mounted on said front panel for directing a light beam forwardly of the assembly, a blower housing mounted on said side walls, a blower mounted in said housing, said blower housing being generally cylindrical in configuration and having a tangential air outlet, a handle attached to said blower housing to enable the assembly to be carried to a desired site of use, an electrical cord for supplying electrical energy to the outlet socket means, light and blower, switch means for selectively actuating the blower and light, said electrical outlet socket means being directly electrically connected with the cord for energization, said blower housing having end walls with each end wall including a generally circular air inlet, and means connecting the blower housing to the side walls of the chassis for pivotal movement of the housing about a horizontal axis generally parallel to the front panel without interference with air entering the air inlets for movement of the air outlet between a horizontal position in which air is directed forwardly of the front panel toward a work area illuminated by the light and a vertical position to enable air to be discharged in a desired direction, said handle being offset from the pivot axis of the blower housing to enable application of rotational torque to the blower housing for pivoting the blower housing, said connecting means between the blower housing and side walls of the chassis including an opening in each side wall defined by an inwardly extending cylindrical flange extending through an air inlet for a short distance, said flanges being closely received in said air inlets to enable the blower housing to rotate about an axis generally at the center of the air inlets.

2. The assembly as defined in claim 1 wherein at least one of said flanges is removably secured to the side wall of the chassis to enable assembly of the blower housing and chassis.

3. The assembly as defined in claim 2 wherein said blower includes an electric motor, means supporting the motor concentrically through one of flanges in spaced relation to provide an annular airflow path therebetween and a screen in said other opening to enable inward airflow but preventing access to the blower.

4. The assembly as defined in claim 3 wherein said blower includes a squirrel cage fan disposed in said housing and disposed in spaced concentric relation to the inner end of the motor.

* * * * *